US009903656B2

(12) United States Patent
Guichard et al.

(10) Patent No.: US 9,903,656 B2
(45) Date of Patent: Feb. 27, 2018

(54) TOOLING FOR SUPPORTING METAL PARTS DURING HEAT TREATMENT

(71) Applicant: HERAKLES, Le Haillan (FR)

(72) Inventors: Frédéric Guichard, Saint-Médard-en-Jalles (FR); Jean-Pierre Maumus, Saint-Médard-en-Jalles (FR)

(73) Assignee: AIRBUS SAFRAN LAUNCHERS SAS, Paris (FR)

( * ) Notice: Subject to any disclaimer, the term of this patent is extended or adjusted under 35 U.S.C. 154(b) by 701 days.

(21) Appl. No.: 13/849,106

(22) Filed: Mar. 22, 2013

(65) Prior Publication Data

US 2013/0252191 A1 Sep. 26, 2013

(30) Foreign Application Priority Data

Mar. 23, 2012 (FR) ..... 12 52605

(51) Int. Cl.

*F27D 5/00* (2006.01)
*C21D 9/00* (2006.01)
*C21D 1/673* (2006.01)

(52) U.S. Cl.

CPC ..... *F27D 5/0006* (2013.01); *C21D 1/673* (2013.01); *C21D 9/0025* (2013.01); *C21D 9/0068* (2013.01)

(58) Field of Classification Search

USPC ..... 432/253, 9, 121, 126, 136; 266/274; 269/9, 289 MR, 266

See application file for complete search history.

(56) References Cited

U.S. PATENT DOCUMENTS 4,797,248 A * 1/1989 Tsitsichvili ..... G21C 19/10 294/119.1
5,066,229 A * 11/1991 Kitajima ..... F16D 69/0408 34/380
5,108,080 A * 4/1992 James ..... B25B 1/2426 269/136
5,201,502 A * 4/1993 Schneider ..... B25B 5/10 269/221

(Continued)

FOREIGN PATENT DOCUMENTS

DE 144 652 10/1980
EP 2 014 777 1/2009

(Continued)

OTHER PUBLICATIONS

International Search Report as issued for PCT/FR2011/051770.

*Primary Examiner* — Nathaniel Herzfeld
(74) *Attorney, Agent, or Firm* — Pillsbury Wintrop Shaw Pittman LLP

(57) ABSTRACT

A support tooling for supporting at least one metal part that is to be subjected to heat treatment or shaped while hot, the tooling including: a stationary support structure presenting a determined shape that corresponds to the general shape of each metal part that is to be supported; first holder elements arranged on one side of each part; second holder elements arranged on the other side of each part; and at least one spring type resilient element placed between the support structure and each first or second holder element so as to hold the part throughout the duration of heat treatment. The support structure, the first and second holder elements and the resilient element(s) are made of thermostructural composite material.

17 Claims, 10 Drawing Sheets

(56) References Cited

U.S. PATENT DOCUMENTS 5,350,163 A * 9/1994 Lichtenberg ..... B25B 5/102 269/156
5,415,715 A * 5/1995 Delage ..... B29D 99/0089 156/197
6,003,756 A * 12/1999 Rhodes ..... B22C 7/00 144/346
6,062,553 A * 5/2000 Strehl ..... B25B 1/2452 269/153
6,250,619 B1 * 6/2001 Cook ..... B23Q 1/035 269/20
7,361,015 B2 * 4/2008 Shimizu ..... C21D 1/42 148/646
7,975,997 B2 * 7/2011 Shimai ..... H01L 21/68742 118/500
8,161,642 B2 * 4/2012 Kobayashi ..... B28B 13/04 264/630
2001/0037755 A1 * 11/2001 Wakasugi ..... D05C 9/04 112/470.14
2003/0205910 A1 * 11/2003 Tjoelker ..... B60J 5/0443 296/146.6
2004/0113461 A1 * 6/2004 Shimizu ..... C21D 1/673 296/193.06
2004/0169321 A1 * 9/2004 Tanaka ..... B21D 53/88 264/449
2006/0082040 A1 4/2006 Shimizu et al.
2006/0108729 A1 * 5/2006 Siegel ..... B25B 1/08 269/266
2006/0180729 A1 * 8/2006 Yang ..... E04H 12/2215 248/508
2011/0291342 A1 * 12/2011 Gindy ..... B25B 1/2421 269/266
2012/0060354 A1 * 3/2012 Koczera ..... B23Q 3/06 29/559

FOREIGN PATENT DOCUMENTS

EP 2 182 082 5/2010
FR 2 858 049 1/2005

* cited by examiner

TOOLING FOR SUPPORTING METAL PARTS DURING HEAT TREATMENT

CROSS REFERENCE TO RELATED APPLICATIONS

This application claims priority to French Application No. 1252605, filed Mar. 23, 2012, the content of which is incorporated herein by reference in its entirety.

BACKGROUND OF THE INVENTION

The present invention relates to support tooling used for supporting metal parts while subjecting those parts to heat treatments such as annealing, brazing, shaping, etc.

Heat treatments of parts made of metal material, such as titanium or other materials, are performed at high temperatures that may exceed 1000° C. By way of example, with parts made of titanium, it is common practice during fabrication to subject a part to a so-called "anneal" heat treatment at temperatures at which titanium becomes soft. Under such circumstances, the titanium part deforms (creeps) merely under the effect of gravity, and it remains deformed after it has cooled. The part may also twist during reductions of temperature as a result of internal stresses being released.

Thus, very heavy single-piece metal supports, e.g. made of refractory steel, are generally used for supporting a part during heat treatment. Nevertheless, the use of such supports presents several drawbacks.

Firstly, such supports are usually very bulky and heavy. Consequently they reduce the loading capacity of the oven used for the heat treatments, while also being difficult to handle. They also present significant thermal inertia, which leads to large amounts of energy consumption in order to raise the tooling to high temperature, and they require long periods of time for cooling, thereby reducing the productivity of the installation. In addition, such large thermal inertia puts a limit on the temperature gradients needed for obtaining the desired microstructure. That type of support also presents a coefficient of thermal expansion that is high, usually different from that of the material of the part being treated, thus limiting its use to parts having geometrical shapes that are simple and making it necessary to provide for large amounts of reshaping by machining of the parts in order to ensure they end up with their intended geometrical configuration.

Finally, that type of support deforms during heat treatments as a result of repeated thermal shocks.

SUMMARY OF THE INVENTION

Consequently, an aspect of the present invention is to propose novel support tooling for supporting metal parts that are to be subjected to heat treatments, which tooling, in addition to being lighter in weight, more compact, and of smaller thermal inertia in the oven, also makes it possible to comply exactly with the geometrical configurations of the parts, be they very simple or very complex, and with this continuing to apply even if the parts move during temperature variations. Another aspect of the invention is to provide tooling that does not creep during heat treatments and that conserves its mechanical characteristics over time.

There also exists a need to have tooling that is capable of hot-shaping a part that was out of tolerance when cold.

To this end, the invention provides support tooling comprising:

a stationary support structure presenting a determined shape that corresponds to the general shape of each metal part that is to be supported;

first holder elements arranged on one side of each part;

second holder elements arranged on the other side of each part; and at least one spring type resilient element placed between the support structure and each first or second holder element so as to hold the part throughout the duration of heat treatment;

the support structure, the first and second holder elements, and the spring elements being made of thermostructural composite material, e.g. a carbon/carbon composite material or a ceramic matrix composite (CMC) material.

The tooling of the invention holds a metal part resiliently in a housing that compiles with the intended final geometrical configuration of the part, thus enabling the part to be held accurately in its geometrical configuration during heat treatment, or to be shaped accurately into its geometrical configuration during heat treatment. The structure defining the housing, and also the elements of the support system, are all made of thermostructural composite material, i.e. of a material that has a coefficient of thermal expansion that is very small, so the tooling is subjected to very little deformation during temperature variations, and the spring elements present stiffness, and consequently they present a bearing force against the holder elements, that is practically constant regardless of temperature.

Because of the resilient holding force that is exerted on the part in almost uniform manner regardless of temperature, it is possible to shape the part during the heat treatment, and thus to correct deformations that have arisen during prior operations performed on the part, such as pre-machining, to as close as possible to the final design dimensions. The principle of the invention whereby the part is held resiliently in the tooling enables a relatively deformed part to be installed in the tooling, which part is initially (i.e. when cold) not in contact with all of the reference holder elements, but once its temperature has been raised, it is stressed by the spring elements and is therefore shaped to have the desired geometrical configuration. Such hot-shaping would be very difficult to implement using metal tooling.

Because of the thermostructural composite material used for making the component elements of the tooling of the invention, the tooling is much more compact and lighter in weight than the tooling made of the refractory steel that is conventionally used. The tooling of the invention thus makes it possible to increase the capacity of a given oven to be loaded with metal parts for treatment, thus making it possible to reduce the cost of such heat treatment. It also makes it possible to reduce the amount of manipulations and treatments needed for a given number of parts, thereby making it possible to reduce the cost of such heat treatments significantly.

In an embodiment of the invention, the tooling comprises a plurality of pairs of jaws placed on either side of the metal part, each pair of jaws being slidably mounted on the support structure. The movements of the part during temperature rises or falls can thus be accompanied by the jaws without exerting stress on the part and while complying with its accurate geometrical configuration as defined by the support structure of the tooling.

For this purpose, each jaw is provided with at least one guide that co-operates with a slideway formed in the support structure. In an embodiment of the invention, the side walls of the support structure include at least one slideway for receiving a guide of one jaw of a jaw pair, spring elements being interposed between at least one jaw of each jaw pair and the side walls of the support structure.

The support structure may present a housing that includes at least a first portion extending in a first plane, and a second portion extending in a second plane forming an angle relative to the first plane. It is thus possible to hold and to shape a single part in a plurality of different planes that form angles relative to one another in one or more directions.

This configuration of the support tooling involving varying planes may also be obtained with a support structure presenting a housing that extends in a first plane and in which at least one portion is provided with angular wedges arranged between one or more pairs of jaws and the side walls of the support structure in such a manner that the portion of the housing that is present between the angular wedges extends in a second plane forming an angle with the first plane.

In another embodiment of the invention, the tooling includes a plurality of spacer elements interposed between first and second metal parts and a plurality of jaws placed against the first metal part and a plurality of thrust plates placed against the second metal part, the spring elements being interposed between the jaws and the support structure.

In this embodiment, the spring elements may be connected to the jaws by first hinged connections to the support structure by second hinged connections, the spacer elements resting on carriages that are movable on the support structure, and the thrust plates being held against rollers secured to the support structure. In this way, all of the holder elements are suitable for moving with the metal parts relative to the stationary support structure and can thus accompany the movements of the parts during temperature variations.

The support structure, the first and second holder elements, and each spring type resilient element may be made of carbon/carbon composite material.

In an aspect of the invention, each resilient element presents predetermined stiffness when cold, thereby defining the holding force applied by the jaws on the part, with this being applicable over a large range of temperatures since the spring element is made of thermostructural composite material.

The invention also provides a heat treatment installation comprising an oven and one or more pieces of support tooling of the invention placed inside the oven.

BRIEF DESCRIPTION OF THE DRAWINGS

Other characteristics and advantages of the invention appear from the following description of particular embodiments of the invention given as non-limiting examples and with reference to the accompanying drawings, in which.

DETAILED DESCRIPTION OF AN EMBODIMENT

The invention applies in general to tooling serving to support parts made of metal in a precise geometrical configuration during treatments that involve temperature rises such as annealing, quenching, tempering, age-hardening, shaping, hot-brazing, or any other treatment involving temperature variations. A particular but non-exclusive field of application of the invention is that of hot-shaping parts made of titanium or the like, which parts are of large dimensions and of shape that must be compiled with very accurately or corrected while hot (shaping parts out of cold tolerance).

Figure 1:
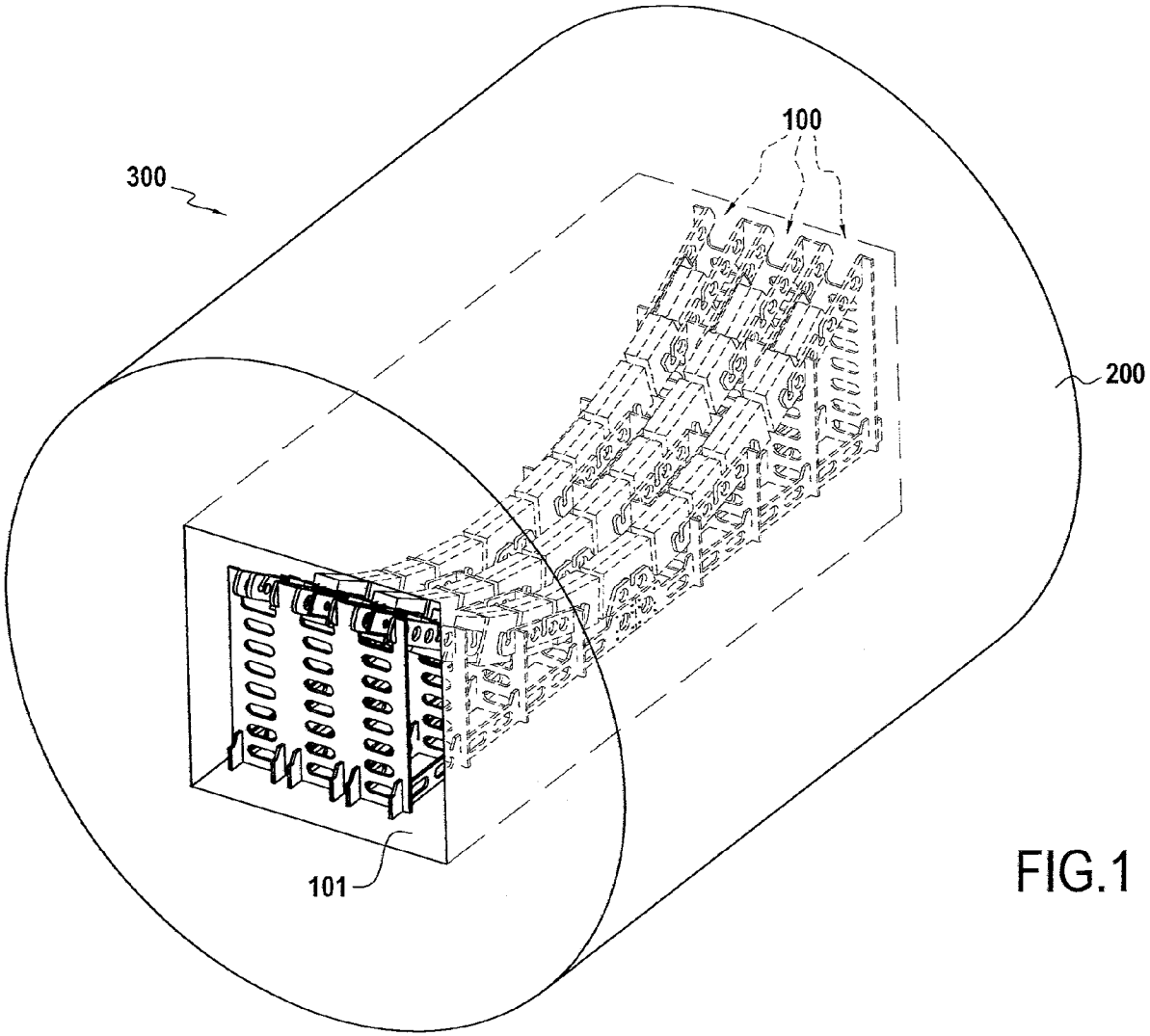
FIG. 1 is a diagrammatic perspective view of a heat treatment installation including support tooling in accordance with the invention.

FIG. 1 shows an installation 300 for heat treating parts made of metal and of shape that must be complied with accurately throughout the treatment. The installation 300 comprises an oven 200 and several pieces of support tooling 100 resting on a base 101.

Figure 2:
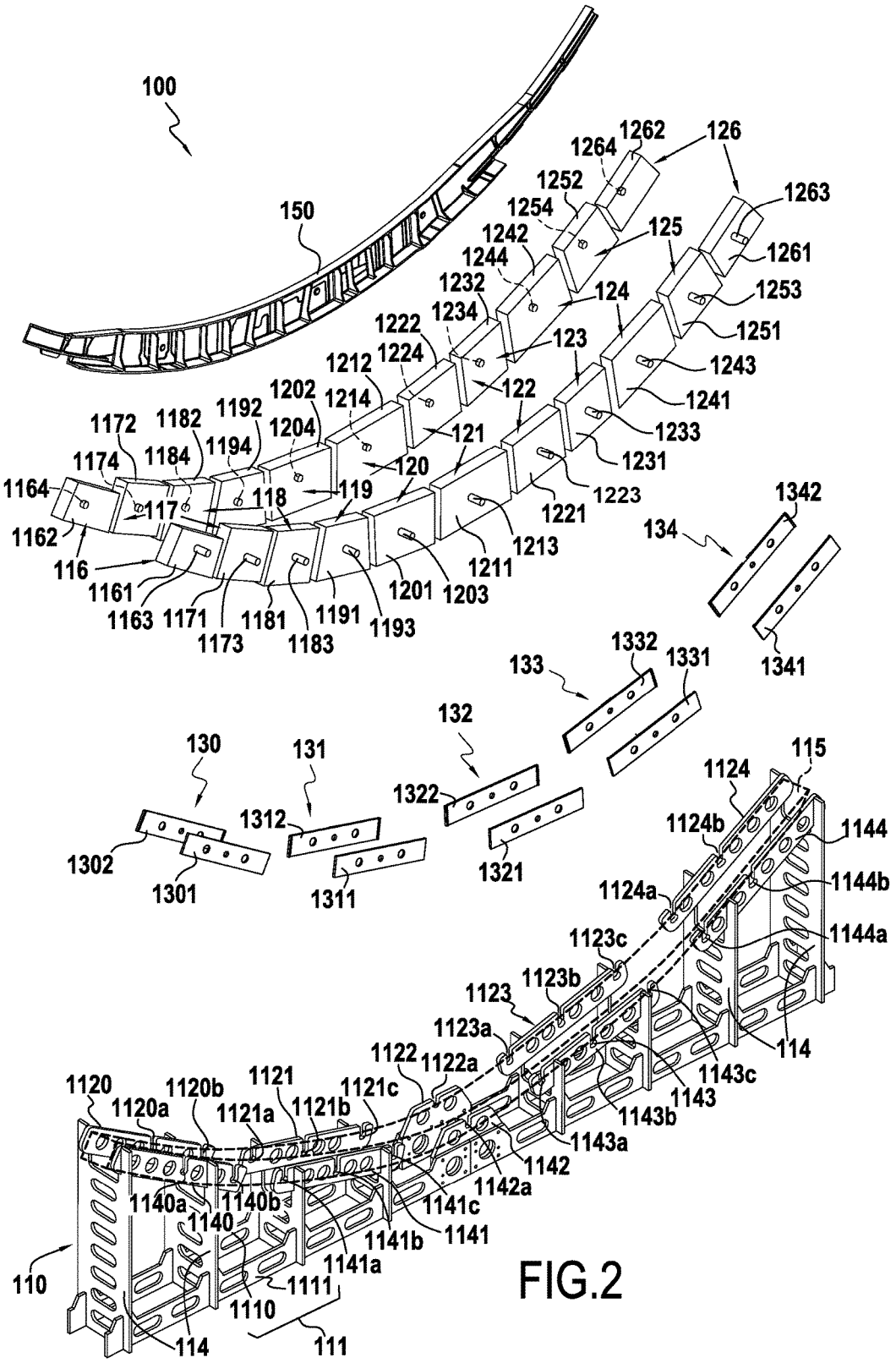
FIG. 2 is an exploded view of support tooling in an embodiment of the invention.
Figure 3:
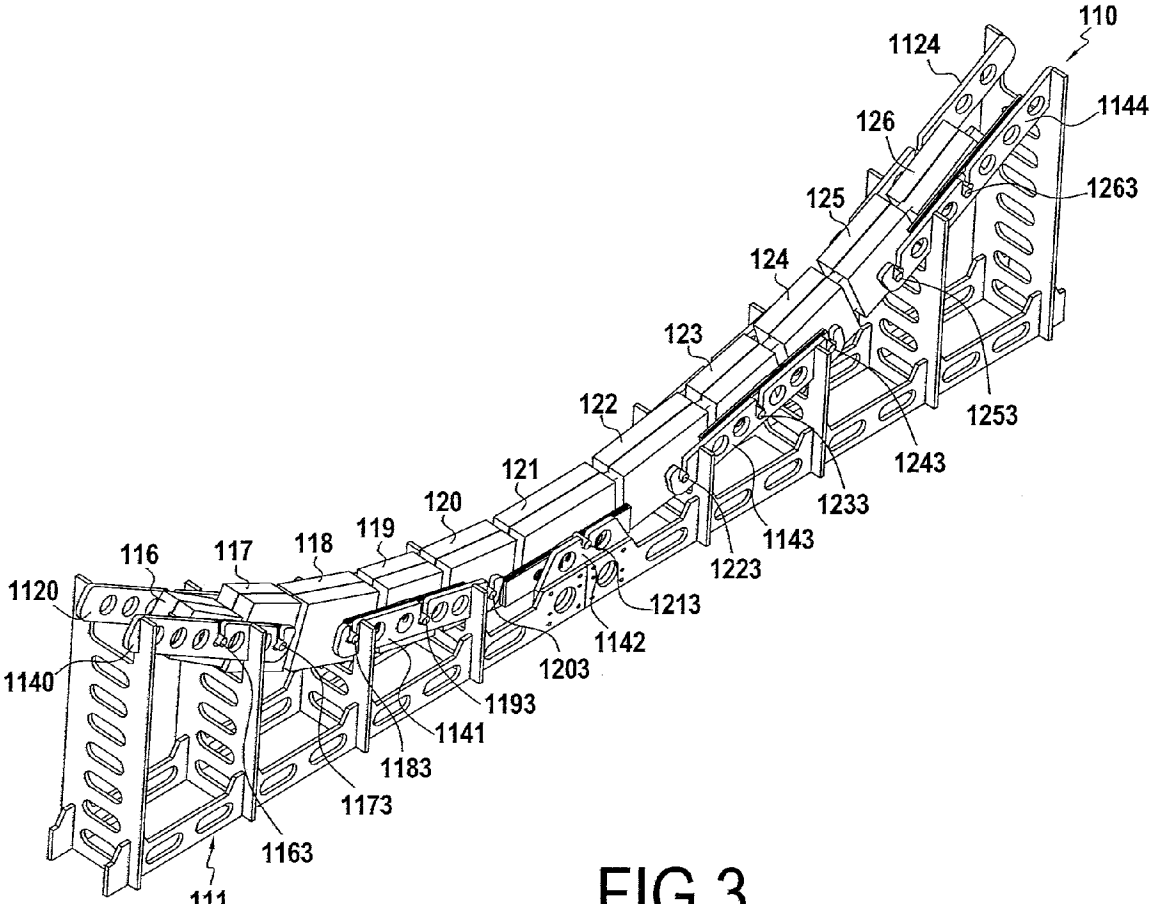
FIG. 3 is a diagrammatic perspective view of the FIG. 2 support tooling once assembled.

As shown in FIGS. 2 and 3, each piece of support tooling 100 comprises a support structure 110. In the presently-described example, the structure 110 is constituted by a frame 111 made up of two stringers 1110 and 1111, and of side walls 1120 to 1124 and 1140 to 1144 held above the frame 111 by uprights 114. The space present between the side walls 1120 to 1124 on one side and the side walls 1140 to 1144 on the other form a housing 115 for a part 150 that is to be subjected to heat treatment. The shape of the housing 115 corresponds to the general shape of the metal part 150 for treating, specifically in this example a part that presents shape that is curved in its longitudinal direction.

Figure 4:
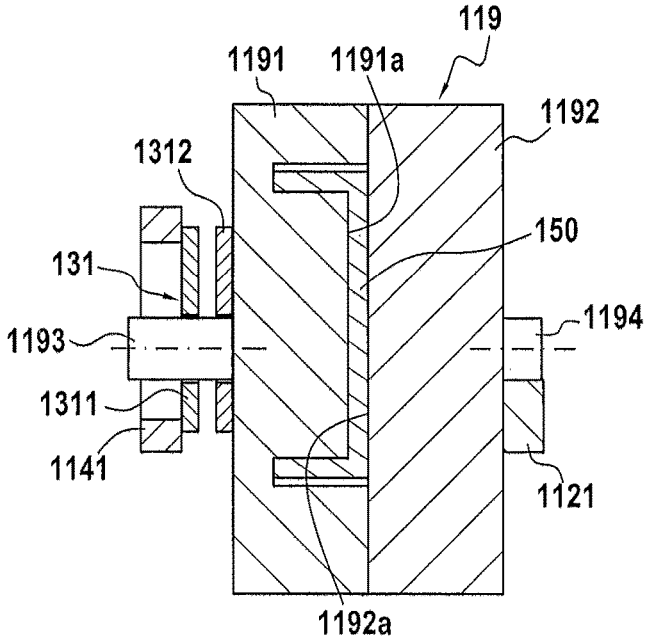
FIG. 4 is a section view of a portion of the FIG. 3 support tooling, the section being marked IV-IV in FIG. 5.

The support tooling 100 also includes a plurality of jaw pairs, in this example jaw pairs 116 to 126, the jaws 1161 to 1261 that are situated on one side of the part 150 corresponding to all or some of the first holder elements of the tooling of the invention, and the jaws 1162 to 1262 situated on the other side of the part corresponding to all or some of the second holder elements of the tooling of the invention. Each jaw pair, such as the pair 119 shown in FIG. 4 is made up of two jaws 1191 and 1192 with the metal part 150 being held between them. For this purpose, the jaws of each pair, such as the jaws 1191 and 1192 of the pair 119 have respective inside faces 1191*a*, 1192*a* of shape that corresponds to the shape of the portion of the part that is to be held at this location of the tooling.

In order to maintain a holding force on the part in the tooling, spring type resilient elements are interposed at least between the outside face of one of the jaws in each jaw pair and the corresponding vertical wall. In the presently-described example, the resilient elements 130 and 134 are interposed respectively between the jaws 1161 to 1261 and the side walls 1140 to 1144, it being possible for thrust plates (not shown) to be interposed between the spring elements and the jaws. Special tooling serving respectively to support the resilient elements 130 to 134 in maximum compression is then used when assembling the part and the jaws in the tooling, with the resilient elements 130 to 134 subsequently being released to exert a holding force on the jaws and on the part in the housing of the tooling.

Each of the resilient elements 130 to 134 is made up respectively of two spring blades 1301/1302, 1311/1312, 1321/1322, 1331/1332, or 1341/1342 that exert a resilient holding force on each pair of jaws 116 to 126, with this depending on the shape of the housing 115 that corresponds accurately to the shape to be complied with of the part.

Furthermore, the jaws 1161/1162 to 1261/1262 of the jaw pairs 116 to 126 are slidably mounted on the side walls. For this purpose, each jaw has a guide on its outside face, the guide being engaged in a slideway formed in the facing side wall of the jaw in question. In the presently-described example, the outside walls of the jaws 1161 to 1261 are provided with respective guides 1163 to 1263, while the outside walls of the jaws 1162 to 1262 are provided respectively with guides 1164 to 1264. The guides 1163 to 1263 are engaged respectively in slideways 1140*a*, 1140*b*, 1141*a*, 1142*b*, 1142*c*, 1142*a*, 1143*a*, 1143*b*, 1143*c*, 1144*a*, 1144*b* of the side walls 1140 to 1144. Similarly, the guides 1164 to 1264 are respectively engaged in sideways 1120*a*, 1120*b*, 1121*a*, 1122*b*, 1122*c*, 1122*a*, 1123*a*, 1123*b*, 1123*c*, 1124*a*, 1124*b* of the side walls 1120 to 1124.

Figure 5:
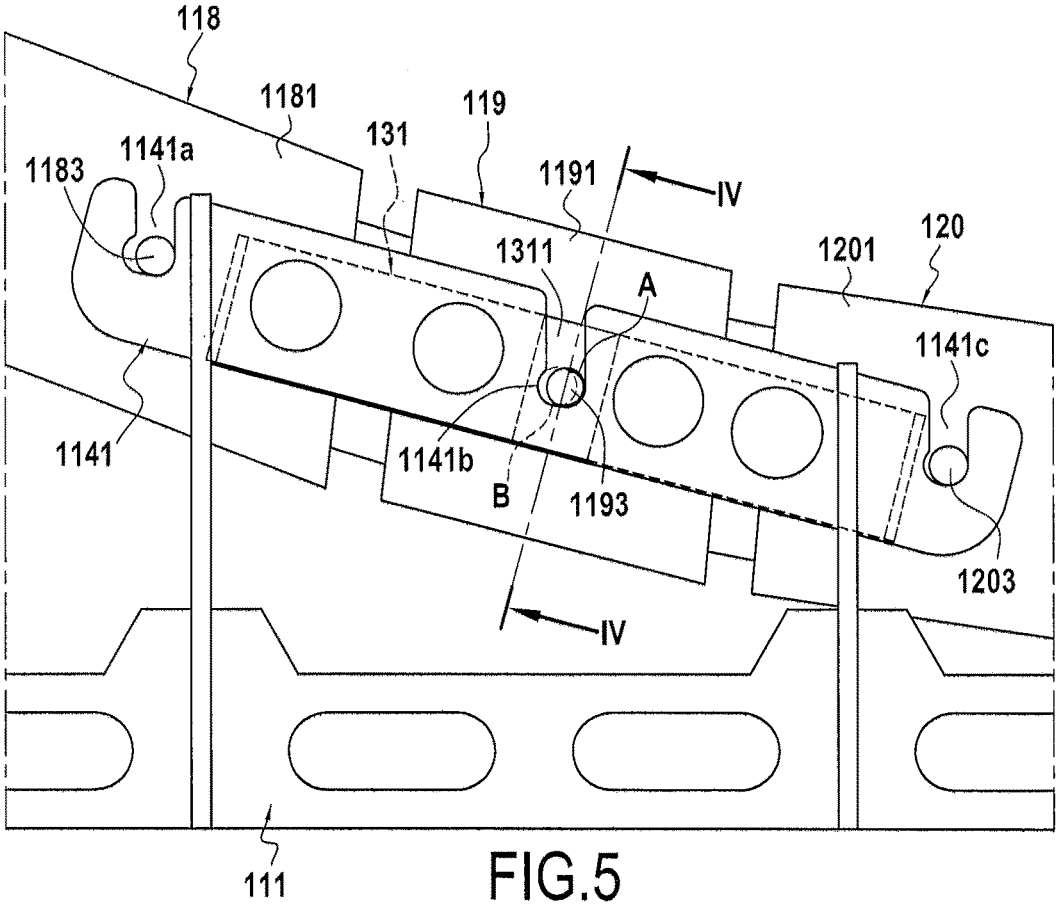
FIG. 5 is a side view of a portion of the FIG. 3 support tooling.

As shown in FIG. 5, the jaw 1191 of the jaw pair 119 is held on the support structure 110 by means of the guide 1193 that is engaged in the slideway 1141*b* formed in the side wall 1141. The slideway 1141*b* is in the form of an oblong hole in which the guide 1193 can move between a first position A corresponding to the position of the holder element when cold and a second position B corresponding to the position of the holder element 1191 when the metal part 150 expands during a temperature rise. The orientation of the oblong hole of the slideway 1131*b* and its position on the side wall 1131 that is oriented depending on the shape of the part in the longitudinal direction, here a curved shape, enable the support system constituted by the holder elements associated with the resilient elements to follow the movements of the part as it expands and/or contracts while ensuring that its shape is conserved in the support plane(s) defined by the housing in the support structure.

In accordance with the present invention, the elements constituting the support tooling of the present invention such as the support structure, the holder elements of each pair, and the resilient elements of spring type are made of a thermostructural composite material that presents a coefficient of thermal expansion that is low in comparison with metal materials such as steel.

The elements constituting the support tooling are preferably made of carbon/carbon (C/C) composite material, which in known manner is a material made up of carbon fiber reinforcement densified by a carbon matrix and which may optionally be provided with a covering such as for example a ceramic deposit (e.g. SiC). These elements may also be made of a carbon matrix composite (CMC) material, which is a material made up of carbon or ceramic fiber reinforcement densified by a matrix that is at least partially ceramic, such as the following CMC materials:

- carbon-carbon/silicon carbide (C/C—SiC) corresponding to a material made up of carbon fiber reinforcement and densified by a matrix having a carbon phase and a silicon carbide phase;
- carbon/carbon silicon carbide (C/SiC), which is a material made up of carbon fiber reinforcement densified by a silicon carbide matrix; and
- silicon carbide/silicon carbide (SiC/SiC) corresponding to a material made up of silicon carbide fiber reinforcement densified by a silicon carbide matrix.

The fabrication of composite material parts constituted by fiber reinforcement densified by a matrix is well known. It mainly comprises making a fiber structure, in this example made of carbon or ceramic fibers, shaping the structure to a shape that is close to the shape of the part to be fabricated (fiber preform), and densifying the preform with the matrix.

The fiber preform constitutes the reinforcement of the part and its role is essential in terms of mechanical properties. The preform is obtained from fiber textures of carbon or ceramic fibers. The fiber textures used may be of various kinds and forms, such as in particular:

- a two-dimensional (2D) woven fabric;
- a three-dimensional (3D) woven fabric obtained by 3D weaving or by multiple layers;
- a braid;
- a knit;
- a felt; or
- a unidirectional (UD) sheet of yarns or tows or multidirectional sheets (nD) obtained by superposing a plurality of UD sheets in different directions and bonding the UD sheets together, e.g. by stitching, by a chemical bonding agent, or by needling.

It is also possible to use a fiber structure made up of a plurality of superposed layers of fabric, braid, knit, felt, sheets, tows, etc., which layers are connected together for example by stitching, by implanting yarns or rigid elements, or by needling.

Shaping is performed by weaving, stacking, needling two-dimensional/three-dimensional plies or sheets of tows, etc.

Therefore the fiber preform is densified in well-known manner using a liquid technique and/or a gaseous technique.

Densification using a liquid technique consists in impregnating the preform with a liquid composition containing a precursor of the matrix material. The precursor is usually in the form of a polymer, such as a resin, possibly diluted in a solvent. The precursor is transformed into carbon or ceramic by heat treatment, after eliminating the solvent, if any, and cross-linking the polymer. A plurality of successive impregnation cycles may be performed in order to reach the desired degree of densification.

By way of example, a carbon precursor resin may be a resin of phenolic type.

By way of example, a ceramic precursor resin may be a polycarbonsilane resin that is a precursor for silicon carbide (SiC), or a polysiloxane resin that is a precursor for SiCO, or a polyborocarbosilazane resin that is a precursor for SiCNB, or a polysilazane resin (SiCN).

The steps of impregnating and polymerizing the carbon precursor resin and/or the ceramic precursor resin may be repeated several times over, if necessary, in order to obtain determined mechanical characteristics.

It is also possible to densify the fiber preform in conventional manner by a gaseous technique by delivering the matrix by chemical vapor infiltration (CVI). The fiber preform corresponding to the structure to be made is placed in an oven into which a reaction gas phase is admitted. The pressure and the temperature that exist in the oven, and the composition of the gas phase are selected in such a manner as to enable the gas phase to diffuse within the pores of the preform in order to form the matrix therein at the core of the material in contact with the fibers by depositing a solid material that results from decomposing a constituent of the gaseous phase or from a reaction between a plurality of constituents, in contrast to pressure and temperature conditions that are specific to chemical vapor deposition (CVD) methods and that lead exclusively to a deposit on the surface of the material.

A carbon matrix may be formed with hydrocarbon gases such as methane and/or propane that give carbon by cracking, while an SiC matrix can be obtained with methyltrichlorosilane (MTS) that gives SiC by decomposing the MTS.

For a C/C-SiC material, the carbon first phase may be formed with hydrocarbon gases giving carbon by cracking, with the SiC second phase then being deposited on the carbon first phase, e.g. by decomposing MTS.

It is also possible to perform densification by combining a liquid technique and a gaseous technique in order to facilitate working, limit cost, and limit fabrication cycles, while also obtaining characteristics that are satisfactory for the intended utilization.

The elements such as the side walls of the support structure are then machined so as to form the slideways therein and possibly also openings for the purpose of lightening the overall structure and reducing its thermal inertia. Likewise, openings may be machined in the other component elements of the support structure in order to further reduce its weight and its thermal inertia.

The advantage of using a thermostructural composite material such as C/C for the resilient elements of the spring type is being able to retain a predefined stiffness when cold while the temperature is being raised. The force exerted by the holder element on the part thus remains practically constant, with this being independent of temperature variations. This serves to provide very accurate control over the holding or the shaping of the part in its final geometrical configuration, with this applying even when the material of the part is subjected to creep at high temperatures.

Furthermore, since the holder elements of the metal part are slidably mounted on the support structure, they adapt to expansion and contraction of the part during temperature rises and falls in the heat treatment by following the movements of the part while complying with its geometrical configuration since the movements take place as defined by the shape of the housing in the support structure.

The support and the shaping of the metal part in the tooling of the invention may take place in a common plane as applies to the above-described support tooling 100 that has a housing 115 extending in a single plane over the entire length of the housing, i.e. over the entire length of the metal part 150.

Nevertheless, the support tooling of the invention may also serve to support and shape a metal part in a plurality of planes having different orientations. For this purpose, and in a first variant embodiment, support tooling is used in which the support structure defines a housing that is not rectilinear, thereby creating portions that extend at different angles. By way of example, and as shown diagrammatically in FIG. 6A, support tooling 400 comprises a support structure (not shown in FIG. 6A) that defines a housing 415 having a first portion 415*a* in the center and second and third portions 415*b* and 415*c* at its ends that extend in planes that are different from the plane in which the central portion 415*a* extends. More precisely, the central portion 415*a* extends in a plane P1 parallel to reference directions X and Z. The end portion 415*b* extends in a plane P2 forming an angle $\alpha 1$ relative to the plane P1 in the direction X. The end portion 415*c* extends in a plane P3 forming an angle $\alpha 2$ relative to the plane P1 in the direction X.

Figure 6A:
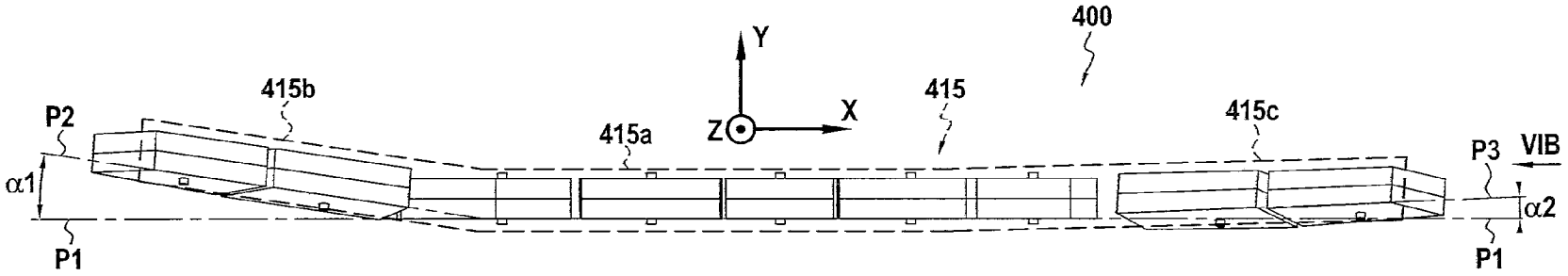
FIGS. 6A and 6B are diagrammatic views of support tooling for supporting a part in a plurality of planes oriented in different directions in accordance with an embodiment of the invention.
Figure 6B:
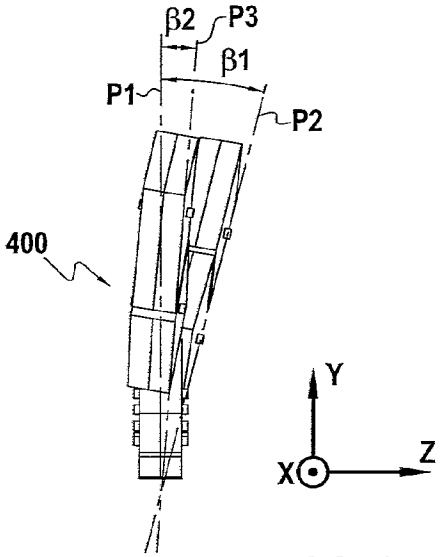

In the presently-described example, the end portions 415*b* and 415*c* are twisted relative to the central portion 415*a*, i.e. the planes P2 and P3 of these portions also extend in the direction Y making respective angles $\beta 1$ and $\beta 2$ with the plane P1 of the central portion 415*a* (FIG. 6B).

Figure 7:
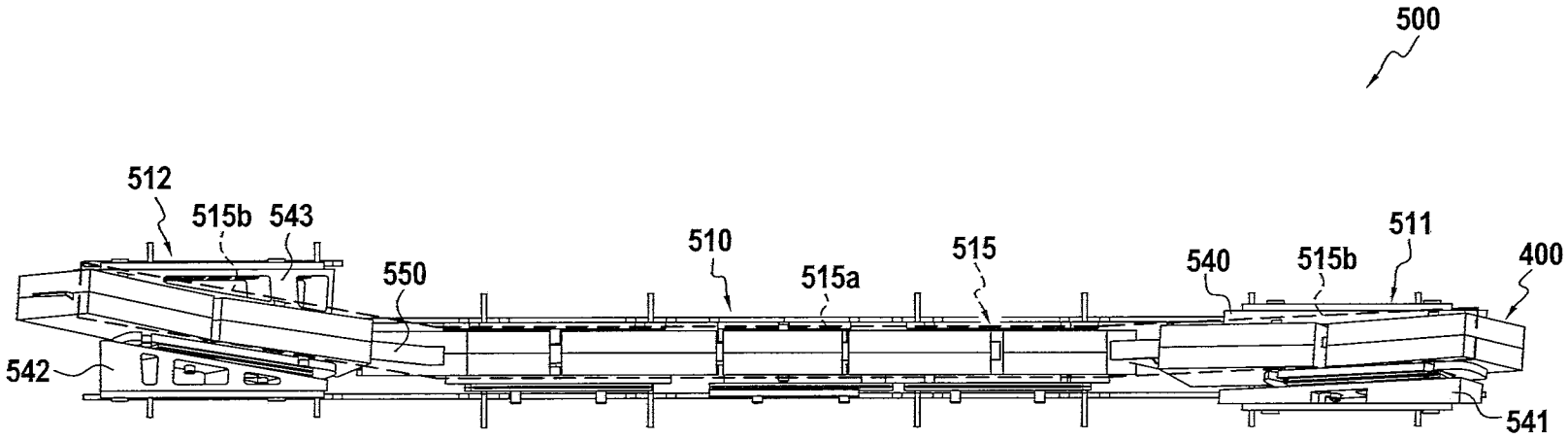
FIG. 7 is a diagrammatic view of support tooling for supporting a part in a plurality of planes oriented in different directions in accordance with another embodiment of the invention.

In a second variant embodiment shown in FIG. 7, the support and shaping of a metal part 550 in compliance with the varying planar geometrical configuration shown in above-described FIGS. 6A and 6B can be achieved by adapting support tooling that has a housing that extends in a single plane as in the above-described tooling 100. For this purpose, and as shown in FIG. 7, support tooling 500 is used in which the support structure 510 extends in a longitudinal direction in a common plane. Pairs of additional angular wedges 540/541 and 542/543 are arranged at the end portions 511 and 512 of the support structure 510 so as to define a housing 515 having a central portion 515*a* that extends in a plane that is identical to the plane P1 described above with reference to FIGS. 6A and 6B, and two end portions 515*b* and 515*c* that extend respectively in planes identical to the planes P2 and P3 described above with reference to FIGS. 6A and 6B. As for the tooling 400, the support tooling 500 makes it possible in the end portions 511 and 512 of the support structure 510 to support the metal part 550 in planes forming one or more angles relative to other support portions of the tooling.

Figure 8B:
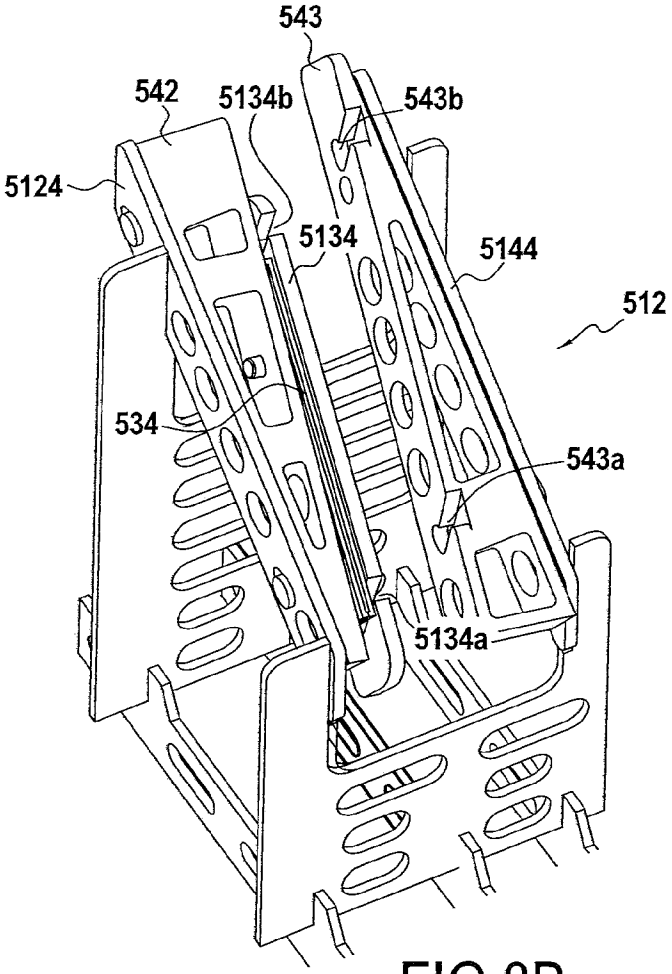
FIGS. 8A and 8B are detail views of portions of the FIG. 7 support tooling.
Figure 8A:
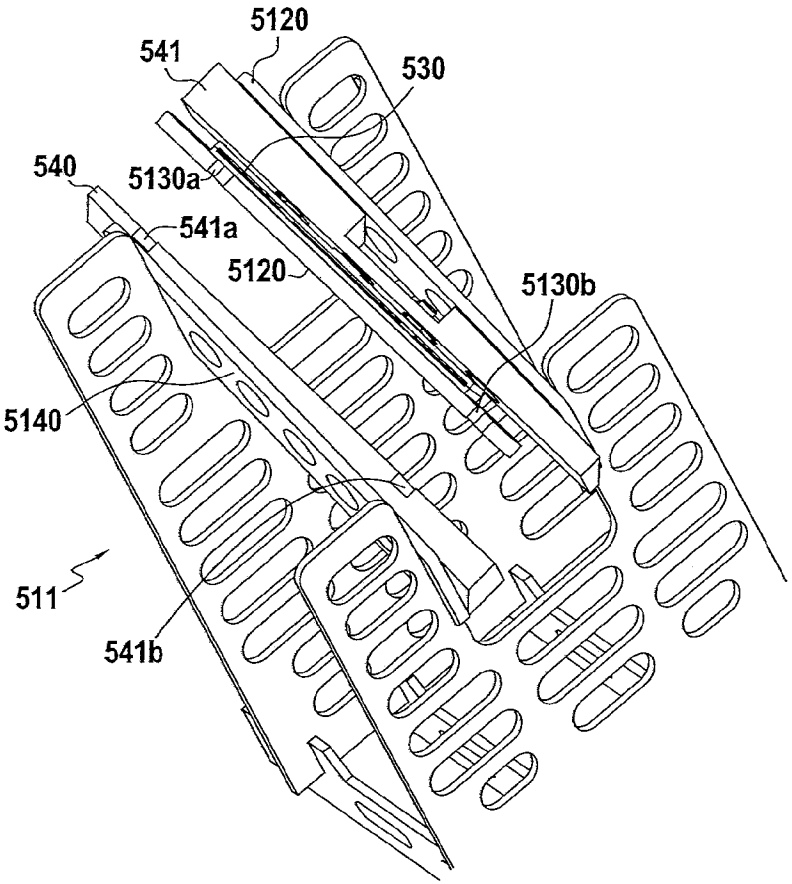

The support structure 510 differs from the above-described support structure 110 in that it presents greater width in its end portions 511 and 512 so as to accommodate pairs of angular wedges 540/541 and 542/543. In the end portion 511, as shown in FIG. 8A, the angular wedge 540 is fastened to one of the side walls 5140 of the support structure, while the wedge 541 is fastened to the opposite side wall 5120. A thrust plate 5130 having slideways 5130*a* and 5130*b* for allowing jaws to move is fastened to the angular wedge 541 with an interposed spring element 530 serving to hold the part resiliently. Likewise, in the end portion 512 as shown in FIG. 8B, the angular wedge 543 is fastened to a side wall 5144 of the support structure, while the wedge 542 is fastened to the opposite side wall 5124. A thrust plate 5134 having slideways 5134*a* and 5134*b* to allow jaws to move is fastened to the angular wedge 543 with an interposed spring element 543 serving to hold the part resiliently.

As a function of the planar shape of the housing of the support tooling and/or of the angle, of the arrangement, and of the number of angular wedges used, the tooling can support and shape a metal part in two or more planes oriented at different angles. In accordance with the invention, the angular wedges are also made of thermostructural composite material, preferably of carbon/carbon composite material.

Figure 9:
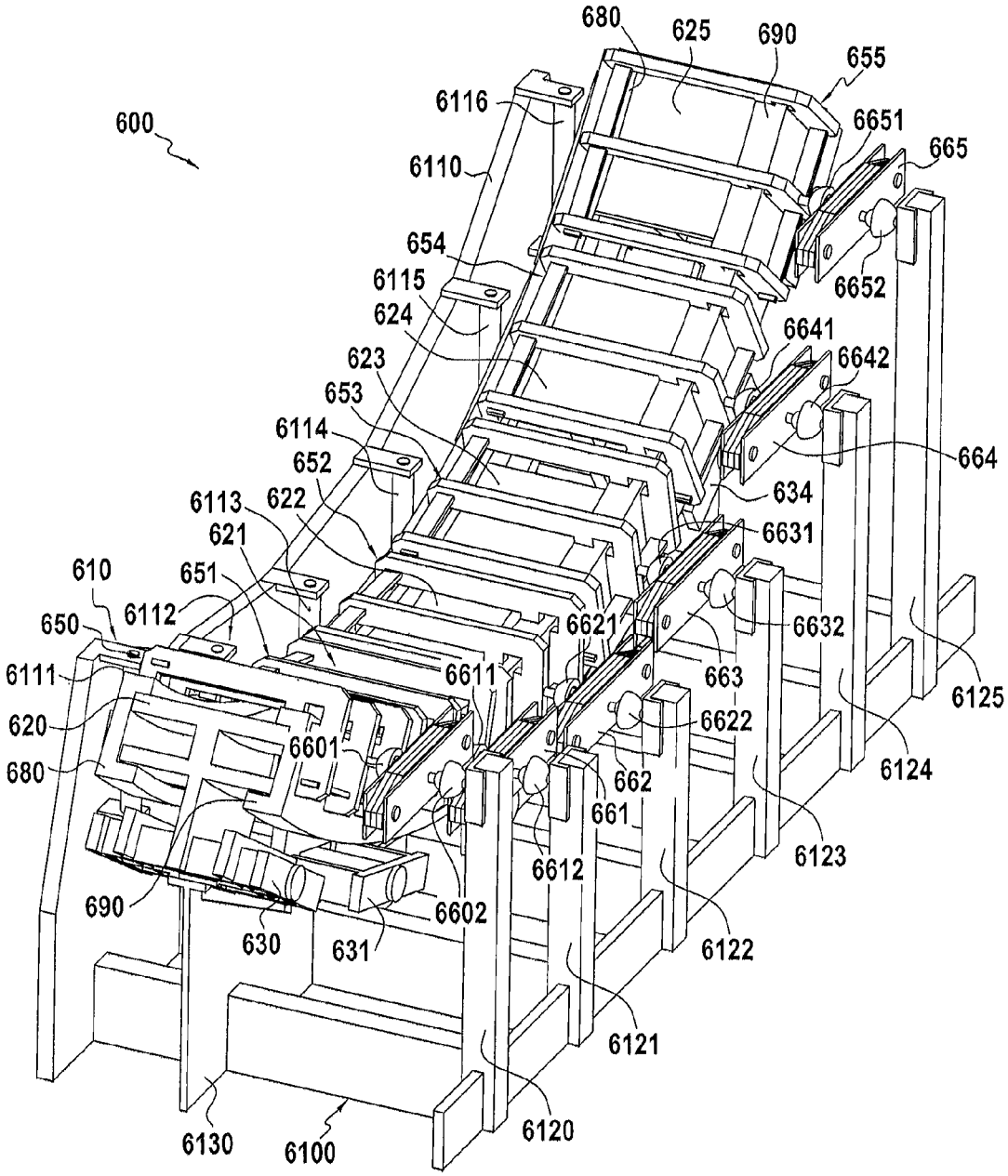
FIG. 9 is a diagrammatic perspective view of support tooling in another embodiment of the invention.
Figure 10:
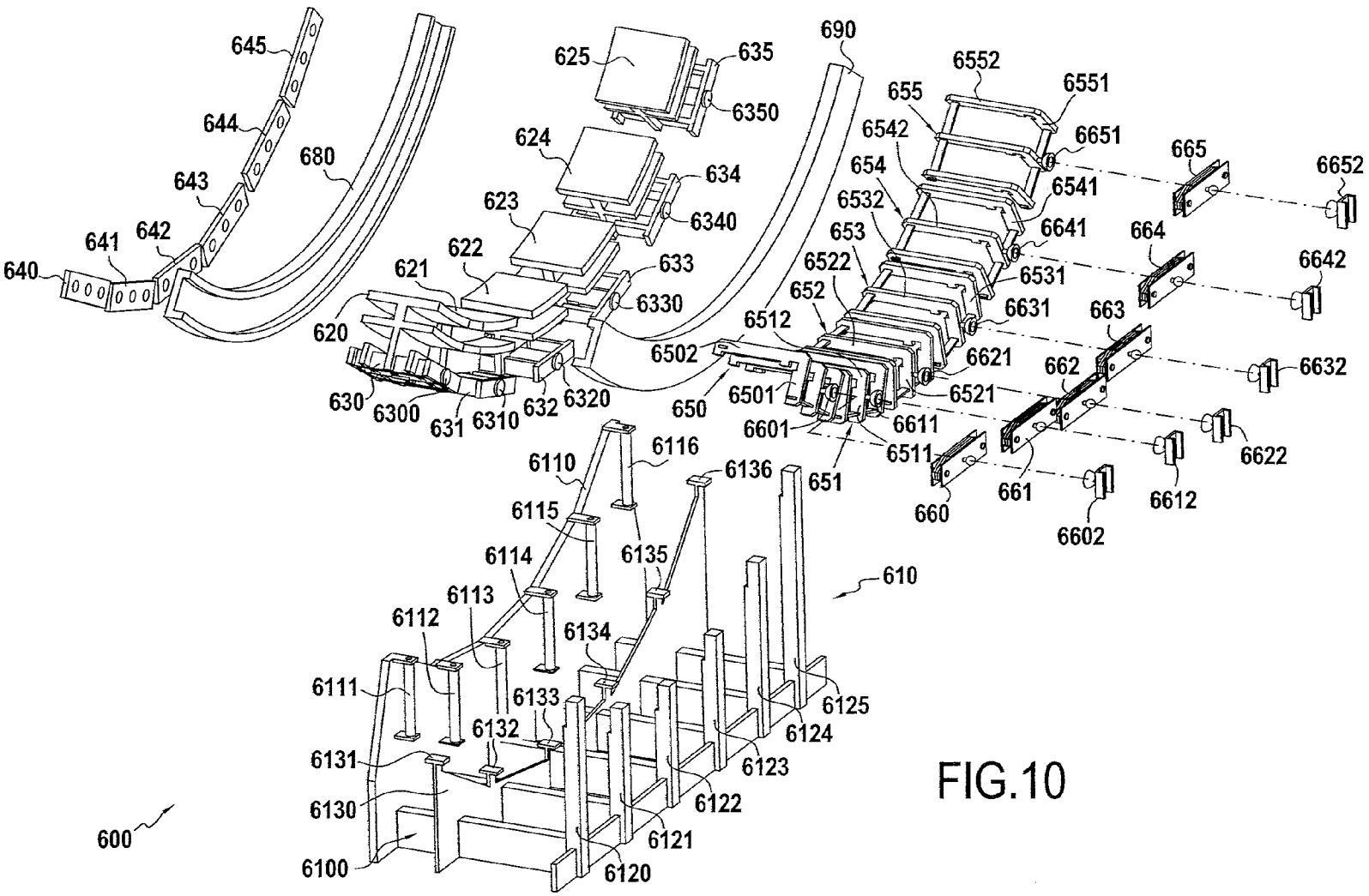
FIG. 10 is an exploded view of the support tooling of FIG. 9.
Figure 11:
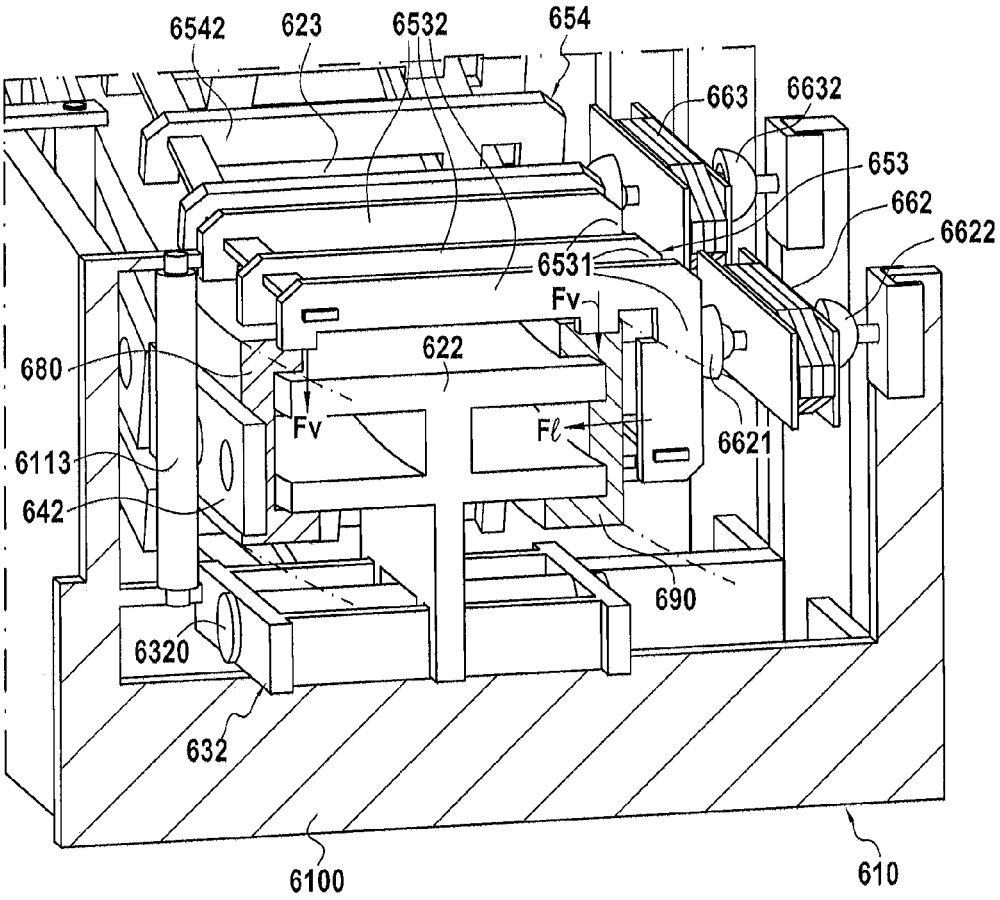
FIG. 11 is a section view of the FIG. 9 tooling.

FIGS. 9 to 11 show support tooling in another embodiment that differs from the above-described embodiment mainly in that the movements (expansion/contraction) of the part during temperature variations are accompanied by holder elements that are mounted on the tooling via movable connections of the ball-joint or roller type.

More precisely, in this embodiment, the support tooling 600 comprises a support structure 610 constituted by a frame 6100 supporting, on one side of the tooling, a side wall 6110 having rollers 6111 to 6116, and on the other side of the tooling, uprights 6120 to 6125. A central wall 6130 having plates 6131 to 6136 is also mounted on the frame 6100 between the side wall 6110 and the uprights 6120 to 6125 (FIG. 10).

The tooling 600 is for supporting two metal parts 680 and 690 simultaneously, which parts have the same final geometrical configuration. For this purpose, the parts 680 and 690 are placed facing each other by means of spacer elements 620 to 625, each mounted on a respective carriage 630 to 635. Each carriage 630 to 635 has a respective roller 6300 to 6350 that presses against a respective plate 6131 to 6136 of the central wall 6130.

The part 680 is also held on its side remote from the spacer elements 620 to 625 by thrust plates 640 to 645, each bearing respectively on one of the rollers 6111 to 6116 of the side wall 6110.

The part 690 is held on its side remote from the spacer elements 620 to 625 by jaws 650 to 655 that have respective side portions 6501 to 6551 and horizontal top portions 6502 to 6552. The jaws 650 to 655 are mounted on the tooling by hinged spring connections. More precisely, spring type resilient elements 660 to 665 are interposed between the resilient jaws 650 to 655 and the corresponding uprights 6120 to 6125. In addition, the resilient elements 660 to 665 are connected to the respective jaws 650 to 655 by ball-joints 6601 to 6651. The resilient elements 660 to 665 are also connected to the uprights 6120 to 6125 of the support structure by ball-joints 6602 to 6652. In this way, the spring elements 650 to 655 and the ball-joints 6601 to 6651 and 6602 to 6652 form hinged resilient connections that enable a holding force to be exerted both laterally and vertically on the parts 680 and 690. As shown in FIG. 11 for the jaw 653, the lateral portions 6531 of the jaw 653 act under the pressure from the spring element 663 to exert a lateral holding force $F_\lambda$ on the parts 680 and 690, while the horizontal top portions 6532 of the jaw 653 acts under pressure from the spring element 663 to exert a vertical holding force $F_v$ on the parts 680 and 690.

In addition to this hinge connection at the jaws making it possible to follow the movements of the metal parts during temperature variations, the spacer elements 620 to 625 and the thrust plates 640 to 645 are also adapted to accompany the movements of the parts while they hold them in the tooling. The spacer elements 620 to 625 are associated with the carriages 630 to 635, each of which rests on one of the plates 6131 to 6136 of the central wall 6130 so as to be movable in the longitudinal direction of the parts. Likewise, the thrust plates 640 to 645 are held against the rollers 6111 to 6116 of the side wall 6110 and can consequently follow the movements of the parts in the tooling.

The tooling 600 thus has holding means that enable metal parts to be supported and/or shaped while hot in a precise geometrical configuration, while adapting to the expansions and contractions of the parts during temperature variations.

The component elements of the tooling 600, and in particular the support structure 610, the spacer elements 620 to 625, the carriages 630 to 635, the thrust plates 640 to 645, the rollers 6111 to 6116, the jaws 650 to 655, and the resilient elements 660 to 665 are made of composite material.

The support tooling 600 is particularly suitable for supporting metal parts of large dimensions since it enables parts of large weight to be held in balanced and reliable manner.

What is claimed is:

1. Support tooling for supporting at least one metal part that is to be subjected to heat treatment or shaped while hot, said tooling comprising:

a stationary support structure presenting a determined shape that corresponds to the general shape of each metal part that is to be supported;

first holder elements arranged along and against one side of each metal part that is to be supported;

second holder elements arranged along and against the other side of each metal part that is to be supported, the one side of the metal part being opposite the other side of the metal part; and at least one spring type resilient element placed between the support structure and each first holder element or between the support structure and each second holder element so as to exert a resilient holding force on each first holder element and on the metal part or on each second holder element and on the metal part to hold the metal part throughout the duration of heat treatment;

the support structure, the first and second holder elements and the at least one spring type resilient element being made of thermostructural composite material, wherein the support tooling includes a plurality of pairs of jaws placed on either side of the metal part, each jaw being slidably mounted on the support structure so that the jaw is slidable along a longitudinal direction of the support structure to accompany a movement of the metal part along the longitudinal direction during the heat treatment, the longitudinal direction being different from a direction along which the resilient holding force is exerted.

2. Tooling according to claim 1, wherein each jaw is provided with at least one guide each co-operating with a respective slideway formed in the support structure.

3. Tooling according to claim 1, wherein each jaw has an inside face for coming into contact with a portion of the metal part, said face presenting a shape corresponding to the geometrical configuration of said portion of the part.

4. Tooling according to claim 1, wherein the support structure presents a housing including at least a first portion extending in a first plane, and a second portion extending in a second plane forming an angle relative to the first plane.

5. Tooling according to claim 1, wherein the support structure presents a housing extending in a first plane and wherein it includes at least a portion provided with angular wedges arranged between one or more pairs of jaws of the plurality of pair of jaws and the side walls of the support structure in such a manner that the portion of the housing that is present between the angular wedges extends in a second plane forming an angle with the first plane.

6. Tooling according to claim 1, wherein the support structure, the first and second holder elements, and each spring type resilient element are made of carbon/carbon composite material or of ceramic matrix composite material.

7. Tooling according to claim 1, wherein each spring type resilient element presents predetermined stiffness when cold.

8. A heat treatment installation comprising an oven and one or more pieces of support tooling according to claim 1 placed inside the oven.

9. Tooling according to claim 1, wherein the spring type resilient element is made up of two spring blades.

10. Tooling according to claim 2, wherein the slideway is an oblong hole.

11. Tooling according to claim 1, wherein at least one of the first holder elements is in contact with at least one of the second holder elements when the metal part is supported by the stationary support structure.

12. Tooling according to claim 1, wherein the plurality of pairs of jaws correspond to all or some of said first and second holder elements.

13. Tooling according to claim 1, wherein the movement is due to expansion or contraction of the metal part during heat treatment.

14. Tooling according to claim 1, wherein the jaw is slidable along the longitudinal direction during the heat treatment without exerting a stress on the metal part.

15. Tooling according to claim 1, wherein the jaw is slidable along the longitudinal direction between a first position corresponding to a position of the jaw before performing the heat treatment and a second position corresponding to a position of the jaw when the metal part expands due to the heat treatment.

16. Tooling according to claim 1, wherein the jaw includes a guide that is slidable along the longitudinal direction in an oblong hole.

17. Tooling according to claim 1, wherein the metal part includes a first end portion and a second end portion that is opposite the first end portion, wherein the first holder elements are arranged along said one side of the metal part from said first end portion to said second end portion, and wherein the second holder elements are arranged along said other side of the metal part from said first end portion to said second end portion.

* * * * *